US005967044A

United States Patent [19]

Marschke

[11] Patent Number: 5,967,044

[45] Date of Patent: Oct. 19, 1999

[54] QUICK CHANGE INK SUPPLY FOR PRINTER

[75] Inventor: Carl R. Marschke, Phillips, Wis.

[73] Assignees: Marquip, Inc.; Phillips, Inc.

[21] Appl. No.: 09/072,091

[22] Filed: May 4, 1998

[51] Int. Cl.[6] ..... B41F 31/04; B41F 31/06; B41F 31/08; B41F 33/16

[52] U.S. Cl. ..... 101/363; 101/484; 101/425; 101/366

[58] Field of Search ..... 101/350.1, 350.6, 101/355, 356, 360, 363, 364, 366, 148, 423, 424, 425; 118/258, 259, 261, 266, 688, 690, 689, 692, 693, 694

[56] References Cited

U.S. PATENT DOCUMENTS 4,787,313 11/1988 Osborn et al. ..... 101/363

5,724,890 3/1998 Deschner et al. ..... 101/366

*Primary Examiner*—J. Reed Fisher

*Attorney, Agent, or Firm*—Andrus, Sceales, Starke & Sawall

[57] ABSTRACT

An on demand ink mixing system for a flexographic or similar printer utilizes a chambered doctor blade with a chamber divided by a flexible bladder to form ink chamber and a pressure chamber. Ink use is coordinated with print run length, and ink mixing and the collapse of the ink chamber to essentially zero volume are coordinated to coincide with the end of the run. The flexible bladder is also utilized in the operation of the ink cleaning system to move cleaning solution through all portions of the supply system and printer contaminated by ink mixed for the run.

14 Claims, 2 Drawing Sheets

QUICK CHANGE INK SUPPLY FOR PRINTER

BACKGROUND OF THE INVENTION

The present invention pertains to an apparatus and method for providing on demand mixing of ink at a printer for effecting rapid clean up at the end of the print run.

In rotary offset or flexographic printing, thin films of ink are applied uniformly to the surfaces of rotating rolls, transferred to the surfaces of adjacent counterrotating rolls which may be intermediate or print rolls, and ultimately to the surface of a web of paper or other material running between a print roll and a counterrotating backing roll. In one common type of flexographic printing apparatus, the printer includes an ink transfer or anilox roll onto the surface of which a thin film of ink of metered thickness is applied in a well known manner utilizing an ink supply reservoir and a doctor blade. A chambered doctor blade is one commonly used device in which a pair of doctor blades engage the surface of the anilox roll and form the upper and lower circumferential walls of an enclosed ink supply chamber.

In conventional flexographic printing, the ink color for a print run is premixed and brought to the printer in a bucket or similar container from which it is fed to a chambered doctor blade or other device for applying ink to the anilox or ink transfer roll. The volume of ink in the bucket must be estimated based on the size of the print run and, as a result, it is common to overestimate and to have a significant amount of mixed ink remaining at the end of the run.

The clean up of ink at the end of a flexographic printing run is also a tedious and time consuming job, often requiring major adjustments and even some disassembly of the equipment. In addition to the excess volume of ink which may remain in the ink supply container, the doctor blade chamber should also be emptied prior to cleaning in order to save ink and to avoid making the clean up job even more difficult.

SUMMARY OF THE INVENTION

In accordance with the present invention, an apparatus and method are provided in which custom color ink is mixed on demand to a volume calculated to coincide with the print run. This system also utilizes a unique variable volume chambered doctor blade, the volume of which may be reduced to essentially zero to coincide with the end of the print run. The variable volume capability may also be utilized to circulate cleaning solution at the end of the run and for change over to the following print run.

In accordance with one embodiment of the invention, the apparatus includes an ink chamber which communicates with a circumferential portion of the surface of the roll (which may be an anilox roll or other ink transfer roll) over substantially the full width of the roll, a first roll surface-engaging doctor blade which closes the ink chamber and defines one circumferential chamber wall, a flexible bladder which defines an ink chamber rear wall and a front wall of a sealed pressure chamber adjacent the ink chamber, an ink supply system adapted to supply ink under pressure to the ink chamber, and a pressure supply system adapted to pressurize the sealed chamber and to cause the bladder to collapse toward the surface of the roll and reduce the volume of the ink chamber in response to an end of print run signal. The ink chamber may include a second doctor blade which defines the other circumferential chamber wall. The apparatus includes a supply manifold which is connected to the ink supply system to distribute ink to the ink chamber uniformly along its axial length.

In the preferred embodiment of the apparatus, the ink supply system includes a mixing device, a plurality of supplies of inks of different colors, a variable volume output device connecting each ink supply to the mixing device, a controller responsive to a selected color signal to operate the output device to supply ink volumes to the mixing device for a mixed ink of the selected color, a bladder position sensor which provides an output signal representative of the volume of the chamber, and a mixed ink volume monitor which provides a dynamic signal representative of the total mixed ink volume used at a selected time during the print run. The controller is responsive to the chamber volume signal and the ink volume signal to cause the pressure supply system to reduce the ink chamber to its smallest volume coincident with the end of the print run. The controller is further responsive to the end of print run signal to halt the supply of ink.

The apparatus also preferably includes a pressurized supply of cleaning solution and a common ink and cleaning solution conduit connecting the ink supply and the cleaning solution supply to the ink chamber. The controller may be operative to provide a selected cycle of alternating operation of the supply of cleaning solution and pressurization of the ink chamber to move cleaning solution into and out of said chamber.

In accordance with a further aspect of the present invention, the apparatus comprises a plurality of ink supplies, a positive displacement metering device delivering ink from each ink supply, a mixing device interconnecting the metering devices and the doctor blade chamber, a volume control device for selectively varying the volume of the doctor blade chamber, a controller responsive to a selected color signal to cause the metering devices to deliver inks to the mixing device to provide mixed ink of the selected color, a mixed ink volume monitor which provides an ink volume signal representative of the volume of mixed ink used for a measured portion of the print run, the controller being responsive to the ink volume signal and a chamber volume signal to cause the volume control device to reduce the chamber volume at a rate to approach zero volume coincident with the end of the print run. The apparatus preferably includes an ink color monitor adapted to provide a signal representative of a deviation from the selected color, the controller being responsive to the color deviation signal to adjust the delivery of ink from a metering device. Each of the metering devices preferably comprises a variable volume metering pump. The apparatus may further include a cleaning system in communication with the mixing device and adapted to supply ink cleaning solution to the mixing device and to the doctor blade chamber, the cleaning system being responsive to the chamber volume control device to move the cleaning solution through the mixing device and into and out of the doctor blade chamber. The volume control device for the doctor blade chamber preferably comprises a flexible chamber wall and a pressure supply which is operative to cause the flexible wall to collapse toward the surface of the roll and to reduce the volume of the chamber.

The present invention also contemplates a method for mixing ink of a selected color on demand for supply to a chambered doctor blade of a print roll, the method comprising the steps of:

(1) providing sources of inks of different colors, (2) supplying selectively metered amounts of inks from said sources to a mixing device to provide mixed ink of the selected color, (3) supplying mixed ink from the mixing device to the doctor blade chamber, (4) providing the chamber with a movable wall operative to vary the volume of the chamber to a minimum essentially zero volume, (5) measuring in real time a portion of the print run completed and the volume of mixed ink used for that portion, (6) calculating the remaining volume of mixed ink required to complete the print run from the measured portion and the volume used, (7) stopping the supply of inks from the sources when the volume used and remaining volume required equal to the total volume of mixed ink supplied, and (8) moving the chamber wall to reduce the chamber volume to essentially zero with completion of the print run.

Preferably, the movable chamber wall comprises a flexible bladder which defines an ink chamber rear wall, and the method includes the steps of pressurizing the outside of the bladder during the print run, and collapsing the bladder into substantially full contact with the print roll surface within the chamber to provide the essentially zero volume position. The method may also include the steps of pumping a cleaning solution into the chamber to expand the bladder, and collapsing the bladder to remove the solution and remaining mixed ink.

DETAILED DESCRIPTION OF THE PREFERRED EMBODIMENT

Figure 1:
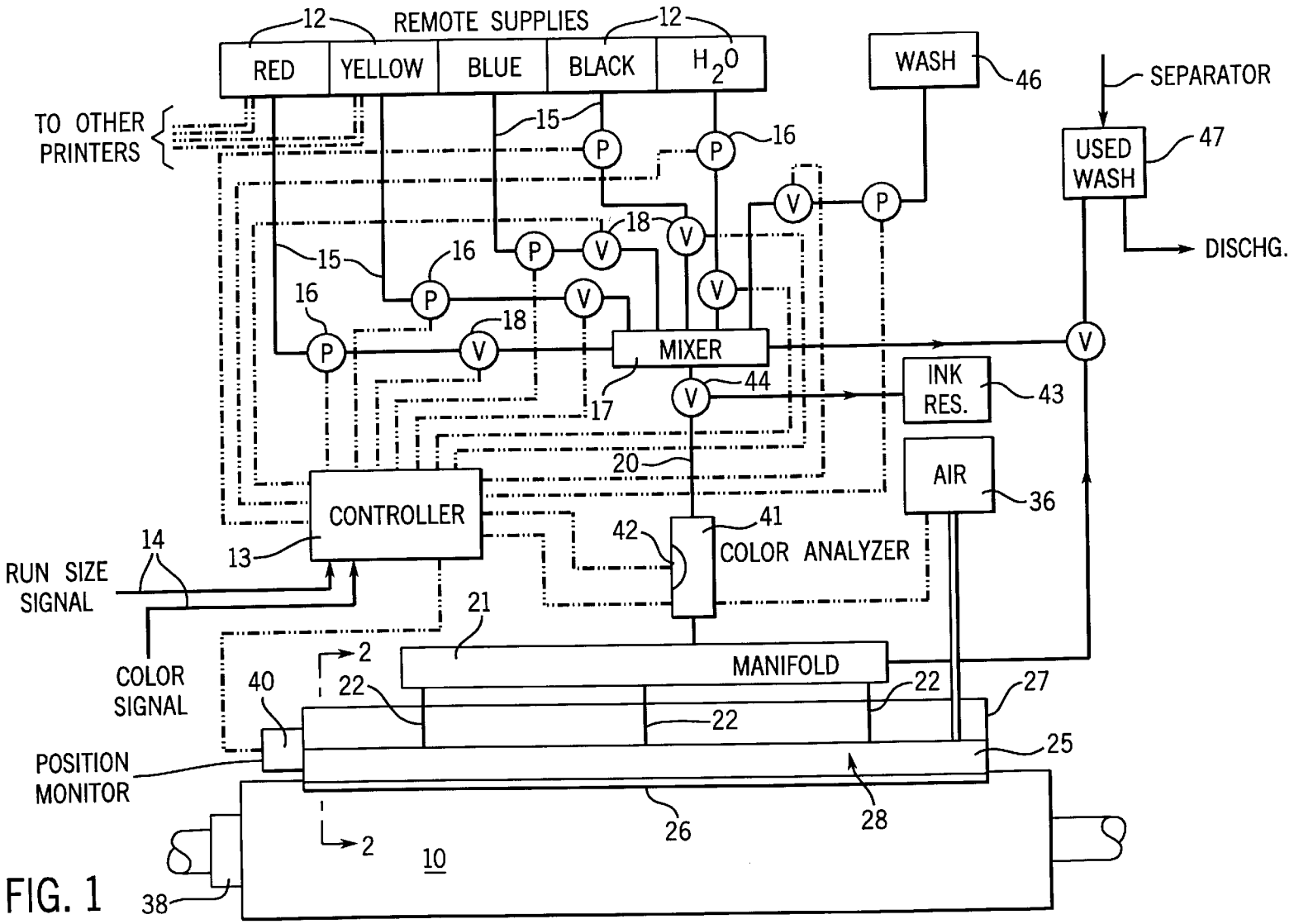
FIG. 1 is a schematic representation of the ink supply and cleaning systems of the present invention.

The system of the present invention replaces the conventional bucket system in which containers of ink premixed to a desired color are positioned at the printer and connected to deliver premixed ink directly to a print roll inking device, such as a chambered doctor blade. The primary improvements in the system of this invention are the ability to mix ink on demand to volumes which coincide precisely with the print run, and to utilize much of the same ink supply system to clean the print rolls at the end of the run. Referring to FIG. 1, ink mixed to a desired color is supplied directly to the surface of a rotating anilox roll 10 from a chambered doctor blade 11 positioned against a circumferential portion of the roll. The system of this invention provides the desired color of mixed ink from one or more remote ink supplies 12 which may also supply ink directly to a plurality of other printers.

The ink supplies typically include the primary colors, red, yellow and blue; a supply of black ink; and a source of white or clear vehicle, typically water with aqueous based inks. Control of the ink mixing and monitoring system is provided by a programmable system controller 13 which provides automatic operation of the system in response to print run inputs 14, such as desired color and print run size, and other measured real time outputs. Each of the ink supplies 12 includes an ink feed line 15 in which is positioned an accurately controllable positive displacement device such as a metering pump 16. Each metering pump supplies ink from its respective ink feed line 15 to a mixer 17 via a shut-off valve 18. The mixer 17 may, for example, comprise a turbine mixer. Each metering pump 16 and shut-off valve 18 is remotely operable under the control of the system controller 13. In response to an input color signal, precise volumes of the component inks are supplied to the mixer 17 and a mixer output line 20 directs the mixed ink to a supply manifold 21. The manifold includes a plurality of connections 22 to supply mixed ink to the chambered doctor blade 11 such that the ink may be uniformly distributed along the axial length of the anilox roll 10.

The chambered doctor blade 11 includes a rigid supporting member 23 which may comprise a generally rectangular section steel tube which runs the full axial length of the chamber. To the front wall 24 of the supporting member 23, between the member and the anilox roll 10, are attached upper and lower mounting brackets 25 to each of which is attached a flexible doctor blade 26. The opposite ends of the front wall 24, mounting brackets 25 and doctor blades 26 are closed and sealed by appropriate end walls 27 to define a doctor blade chamber 28. Within the chamber 28 and attached by its upper and lower edges to the mounting brackets 25, is a flexible bladder 30. The bladder may be made of any suitable natural or synthetic rubber composition. The bladder 30 extends the full length of the chamber 28 and its opposite lateral edges sealingly attached to the opposite end walls 27. The bladder 30 divides the doctor blade chamber 28 into an ink chamber 31 adjacent the circumferential portion of the roll 10 enclosed by the doctor blades 26, and a rear pressure chamber 32 adjacent the front wall 24 of the rigid supporting member 23. Each of the manifold connections 22 extends through the rigid supporting member 23 and includes a bladder connector 33 which provides open communication to the ink chamber 31 but is movable with the flexible bladder 30 in the doctor blade chamber toward and away from the surface of the roll 10. Each bladder connector 33 may comprise a short tube section 34 secured at its front end to the bladder 30 and slidable axially within an end of a manifold connection 22 and sealed with a suitable annular seal 35.

Figure 2:
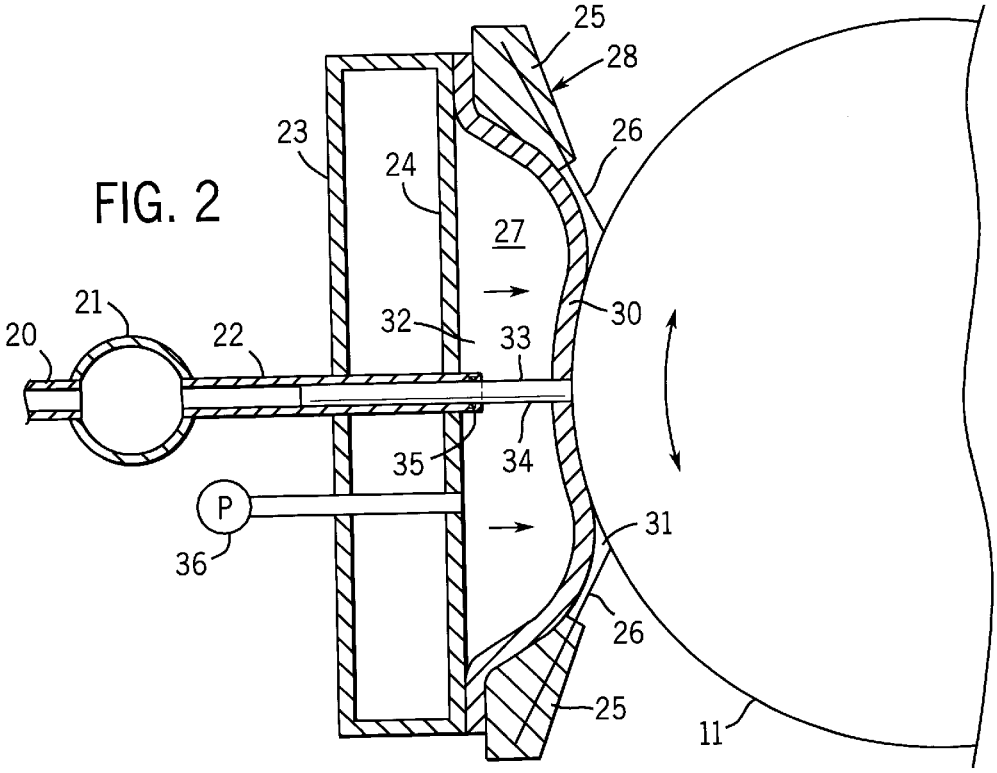
FIG. 2 is an enlarged sectional side elevation taken generally on line 2—2 of FIG. 1 and showing the collapsible doctor blade chamber in its collapsed, zero volume position.
Figure 3:
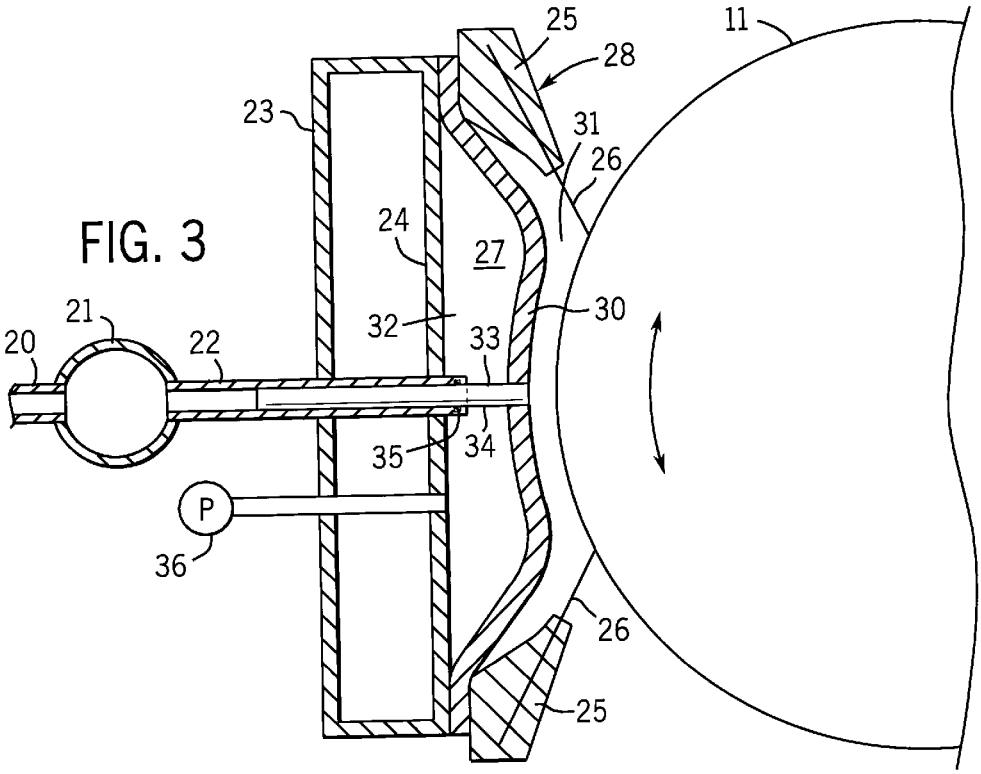
FIG. 3 is a sectional view similar to FIG. 2 showing the flexible chamber wall in its expanded position.

A source of compressed air 36 is connected to the pressure chamber 32 by an air line 37. The supply of air to the pressure chamber 32 is under the control of the system controller 13. The metering pumps 16 and turbine mixer 17 supply mixed ink to the ink chamber 31 under a pressure sufficient to move the bladder 30 rearwardly to allow the ink chamber 31 to expand and fill with mixed ink, as shown in FIG. 2. Conversely, pressure from the compressed air source 36, sufficient to overcome the fluid pressure in the ink chamber, will move the bladder 30 in a forward direction toward the roll 10 collapsing the ink chamber 31, as shown in FIG. 1. As will be discussed further, collapse of the ink chamber 31 may be in controlled response to the transfer of ink from the chamber to the anilox roll 10 and/or to provide a reverse flow of ink or of a cleaning solution from the ink chamber back through the manifold 21 and mixer 17.

As the mixed ink is supplied to the ink chamber 31, the pressure of the ink supply will cause the flexible bladder 30 to expand and fill the chamber with ink. As the printer operates and ink is transferred to the print rolls, the system continues to operate under the direction of the system controller 13 to maintain a supply of mixed ink in the ink chamber. One of the inputs to the controller may be a print run size. As the printer operates, a dynamic sensor 38, such as an encoder, resolver, or other real time measuring device, provides a signal representative of the portion of the print run completed and, with the print run size signal, the controller 13 can provide a signal representative of the volume of ink necessary to complete the print run.

A position sensor 40 is attached to the doctor blade chamber 28 to monitor the position of the bladder 30 and to output to the controller 13 a real time signal representative of the volume of the ink chamber 31. The controller is operative in response to the ink chamber volume and remaining ink volume required signals to operate the compressed air source 36 to cause the bladder to collapse toward a minimum volume coincident with the end of the print run. Simultaneously, the controller is operative to shut-off the ink supplies 12 (i.e. shut down the metering pump 16 and close the shut-off valves 18) when the calculated volume of mixed ink is sufficient to complete the run.

A color analyzer 41 may be positioned downstream of the mixer, e.g. in the mixer output line 20, to continuously monitor the color of the mixed ink and to output a signal to the controller 13. The color analyzer may include a sight glass 42 through which an appropriate spectral analysis can be made to provide the output signal to the controller. The controller, in turn, can dynamically adjust any of the metering pumps 16 in response to a color deviation to restore the color to the one selected.

Most preferably, when the bladder is fully collapsed into contact with the anilox roll 10, the volume of the ink chamber 31 is essentially zero, such that there is little or no mixed ink remaining in the ink chamber and the print run has been completed. If the remaining mixed ink exceeds the print run requirements, the remaining ink could be returned to an ink reservoir 43 by pressurizing the pressure chamber 32 in the same manner and appropriately operating the flow control valve 44.

A portion of the system previously described may be utilized to clean the ink from the mixer 17, manifold 21, ink chamber 31 and print roll surfaces utilizing the pressure chamber and air supply 36. When the print run has been completed and the bladder has been moved to provide an essentially zero volume ink chamber 31, cleaning solution from a source 46 is pumped into the mixer 17, through the output line 20, into and through the manifold 21 and, via the connections 22, into the ink chamber 31. The air pressure is reduced to allow the ink chamber to expand and fill with cleaning solution, the anilox roll may be operated to carry solution to clean its surface and the surfaces of other print rolls to remove the mixed ink without major adjustments or partial disassembly of the printer. Periodically and in a cyclic manner, compressed air may be applied to the pressure chamber 32 to collapse the bladder and force the cleaning solution in the reverse direction back through the mixer, and eventually to a used cleaning solution reservoir 47. The reservoir 47 may include a suitable separator to retain the ink pigments. The remaining cleaning solution may be appropriately discharged. The system may be similarly purged with a separate rinse system (not shown).

The system of the present invention may also be utilized on a flexographic printer used in a process printing system. For process printing, a single color from the remote supplies 12 is supplied and monitored as previously described, but without the need for mixing and color monitoring. The cleaning system may be utilized in this application as previously described.

I claim:

1. An apparatus for delivering a supply of ink to a print roll for a print run of a given size comprising:

an ink chamber communicating with a circumferential portion of the roll surface over substantially the full width of the roll;

a first roll surface-engaging doctor blade closing the ink chamber and defining one circumferential chamber wall;

a flexible bladder defining an ink chamber rear wall and a front wall of a sealed pressure chamber adjacent the ink chamber;

an ink supply system adapted to supply ink under pressure to the ink chamber; and, a pressure supply system for pressurizing the sealed chamber to cause the bladder to collapse toward the surface of the roll and reduce the volume of the ink camber in response to an end of print run signal.

2. The apparatus as set forth in claim 1 including a second doctor blade defining the other circumferential chamber wall.

3. The apparatus as set forth in claim 1 including a supply manifold connected to the ink supply system and adapted to distribute ink to the ink chamber.

4. The apparatus as set forth in claim 1 wherein said ink supply system comprises:

a mixing device;

a plurality of supplies of inks of different colors;

a variable volume output device connecting each ink supply to said mixing device;

a controller responsive to a selected color signal for setting the output device to supply ink volumes to the mixing device to provide mixed ink of the selected color;

a bladder position sensor providing an output signal representative of chamber volume;

a mixed ink volume monitor providing a dynamic signal representative of total ink volume used at a selected time during the print run; and, said controller being responsive to said chamber volume signal and said ink volume signal to cause the pressure supply system to reduce the ink chamber to its smallest volume coincident with the end of the print run.

5. The apparatus as set forth in claim 1 wherein said ink supply system comprises:

a pressurized supply of cleaning solution;

a common ink and cleaning solution conduit connecting the ink supply and the cleaning solution supply to the ink chamber; and, a controller responsive to the end of print run signal to halt the supply of ink.

6. The apparatus as set forth in claim 5 wherein said controller is operative to provide a selected cycle of alternating operation of said supply of cleaning solution and said ink chamber pressure system to move cleaning solution into and out of said chamber.

7. An apparatus for delivering a supply of ink to a chambered doctor blade of a print roll for a print run of a given size comprising:

a plurality of ink supplies;

a positive displacement metering device for delivering ink from each ink supply;

a mixing device interconnecting the metering devices and the doctor blade chamber;

a volume control device for selectively varying the volume of the doctor blade chamber;

a controller responsive to a selected color signal to cause the metering devices to deliver inks to the mixing device from said supplies to provide mixed ink of the selected color;

a mixed ink volume monitor providing an ink volume signal representative of the volume of mixed ink used for a measured portion of the print run; and, said controller responsive to said ink volume signal and a chamber volume signal to cause said volume control device to reduce the chamber volume at a rate to approach zero volume coincident with the end of the print run.

8. The apparatus as set forth in claim 7 including an ink color monitor providing a signal representative of a deviation from the selected color, said controller responsive to the color deviation signal to adjust the delivery of ink from a metering device.

9. The apparatus as set forth in claim 7 wherein each of said metering devices comprises a variable volume metering pump.

10. The apparatus as set forth in claim 7 including a cleaning system in communication with the mixing device and adapted to supply ink cleaning solution to said mixing device and to the doctor blade chamber, said cleaning system being responsive to the chamber volume control device to move the cleaning solution through the mixing device and into and out of said chamber.

11. The apparatus as set forth in claim 7 wherein the volume control device for said doctor blade chamber comprises a flexible chamber wall and a pressure supply operative to cause the flexible wall to collapse toward the surface of the roll and reduce the volume of the chamber.

12. A method for mixing ink of a selected color on demand for supply to a chambered doctor blade of a print roll, said method comprising the steps of:

(1) providing sources of inks of different colors;

(2) supplying selectively metered amounts of inks from said sources to a mixing device to provide mixed ink of the selected color;

(3) supplying mixed ink from the mixing device to the doctor blade chamber;

(4) providing said chamber with a movable wall operative to vary the volume of the chamber to a minimum essentially zero volume;

(5) measuring in real time a portion of the print run completed and the volume of mixed ink used for said portion;

(6) calculating the remaining volume of mixed ink required to complete the print run from said measured portion and volume used;

(7) stopping the supply of inks from the sources when the volume used and remaining volume required equal the total volume of mixed ink supplied; and, (8) moving the chamber wall to reduce the chamber volume to essentially zero with completion of the print run.

13. The method as set forth in claim 12 wherein said movable chamber wall comprises a flexible bladder defining an ink chamber rear wall, and including the steps of:

(1) pressurizing the outside of the bladder during the print run; and, (2) collapsing the bladder into substantially full contact with the print roll surface within the chamber to provide the essentially zero volume position.

14. The method as set forth in claim 13 including the steps of:

(1) pumping a cleaning solution into the chamber to expand the bladder; and, (2) collapsing the bladder to remove the solution and remaining mixed ink.

* * * * *